US008588631B2

(12) United States Patent
Orihara

(10) Patent No.: US 8,588,631 B2
(45) Date of Patent: Nov. 19, 2013

(54) IMAGE FORMING APPARATUS

(75) Inventor: Tatsuaki Orihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 13/198,043

(22) Filed: Aug. 4, 2011

(65) Prior Publication Data

US 2012/0033983 A1 Feb. 9, 2012

(30) Foreign Application Priority Data

Aug. 6, 2010 (JP) ..... 2010-178208
Jul. 5, 2011 (JP) ..... 2011-149449

(51) Int. Cl.
*G03G 15/00* (2006.01)

(52) U.S. Cl.
USPC ..... 399/44; 399/37; 399/50; 399/88

(58) Field of Classification Search
USPC ..... 399/44, 37, 50, 88, 296
See application file for complete search history.

(56) References Cited

U.S. PATENT DOCUMENTS 6,029,024 A * 2/2000 Bae ..... 399/66
2006/0140653 A1* 6/2006 Yoshikawa ..... 399/44

FOREIGN PATENT DOCUMENTS

JP 08-334981 A 12/1996
JP 2005-300745 A 10/2005

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes a rotatable image bearing member including an electroconductive base member and a photosensitive member formed on the electroconductive base member; a contact charging device for electrically charging the photosensitive member; a DC voltage applying device for applying a DC voltage to the contact charging device; an exposure device for exposing the charged photosensitive member to light; and a current detecting device for detecting a current passing from the contact charging device to the electroconductive base member of the image bearing member. The image forming apparatus includes a control device capable of executing an operation in a humidity detecting mode in which an area of the photosensitive member is electrically charged by applying a DC voltage to the contact charging device and the photosensitive member is rotated without exposing the area to the light by the exposure device and then the area is electrically charged again by applying the DC voltage to the contact charging device. The control device detects information on a humidity on the basis of a current detected by the current detecting device when the area is electrically charged again by applying the DC voltage to the contact charging device.

8 Claims, 5 Drawing Sheets

(a)

(b)

IMAGE FORMING APPARATUS

FIELD OF THE INVENTION AND RELATED ART

The present invention relates to an image forming apparatus of an electrophotographic type, such as a copying machine or a laser beam printer. Particularly, the present invention relates to the image forming apparatus capable of detecting a humidity.

In the image forming apparatus of the electrophotographic type, conditions of processes such as charging, development, transfer and cleaning are changed depending on the humidity. For this reason, it has been generally practiced that a sensor for detecting the humidity was provided in the image forming apparatus (Japanese Laid-Open Patent Application (JP-A) 2005-300745).

However, in addition to the necessity to provide a particular sensor for detecting the humidity, from the viewpoints of a temperature distribution in the image forming apparatus and a problem of a disposing (mounting) space, it was difficult to accurately detect the humidity in the neighborhood of a member which most related to image formation.

Further, the detection of the humidity was tried by detecting a resistance of a charging member or a transfer member (JP-A Hei 8-334981) but it was difficult to accurately detect the humidity due to variation in resistance during manufacturing. In addition, there was a need to provide a dedicated electroconductive member contacted to these members.

SUMMARY OF THE INVENTION

A principal object of the present invention is to provide an image forming apparatus capable of accurately and easily detecting a humidity in the neighborhood of a photosensitive member without using a particular sensor or member.

According to an aspect of the present invention, there is provided an image forming apparatus comprising:

a rotatable image bearing member including an electroconductive base member and a photosensitive member formed on the electroconductive base member;

a contact charging device for electrically charging the photosensitive member;

a DC voltage applying device for applying a DC voltage to the contact charging device;

an exposure device for exposing the charged photosensitive member to light; and a current detecting device for detecting a current passing from the contact charging device to the electroconductive base member of the image bearing member, wherein the image forming apparatus comprises a control device capable of executing an operation in a humidity detecting mode in which an area of the photosensitive member is electrically charged by applying a DC voltage to the contact charging device and the photosensitive member is rotated without exposing the area to the light by the exposure device and then the area is electrically charged again by applying the DC voltage to the contact charging device, and wherein the control device detects information on a humidity on the basis of a current detected by the current detecting device when the area is electrically charged again by applying the DC voltage to the contact charging device.

These and other objects, features and advantages of the present invention will become more apparent upon a consideration of the following description of the preferred embodiments of the present invention taken in conjunction with the accompanying drawings.

Figure 2:
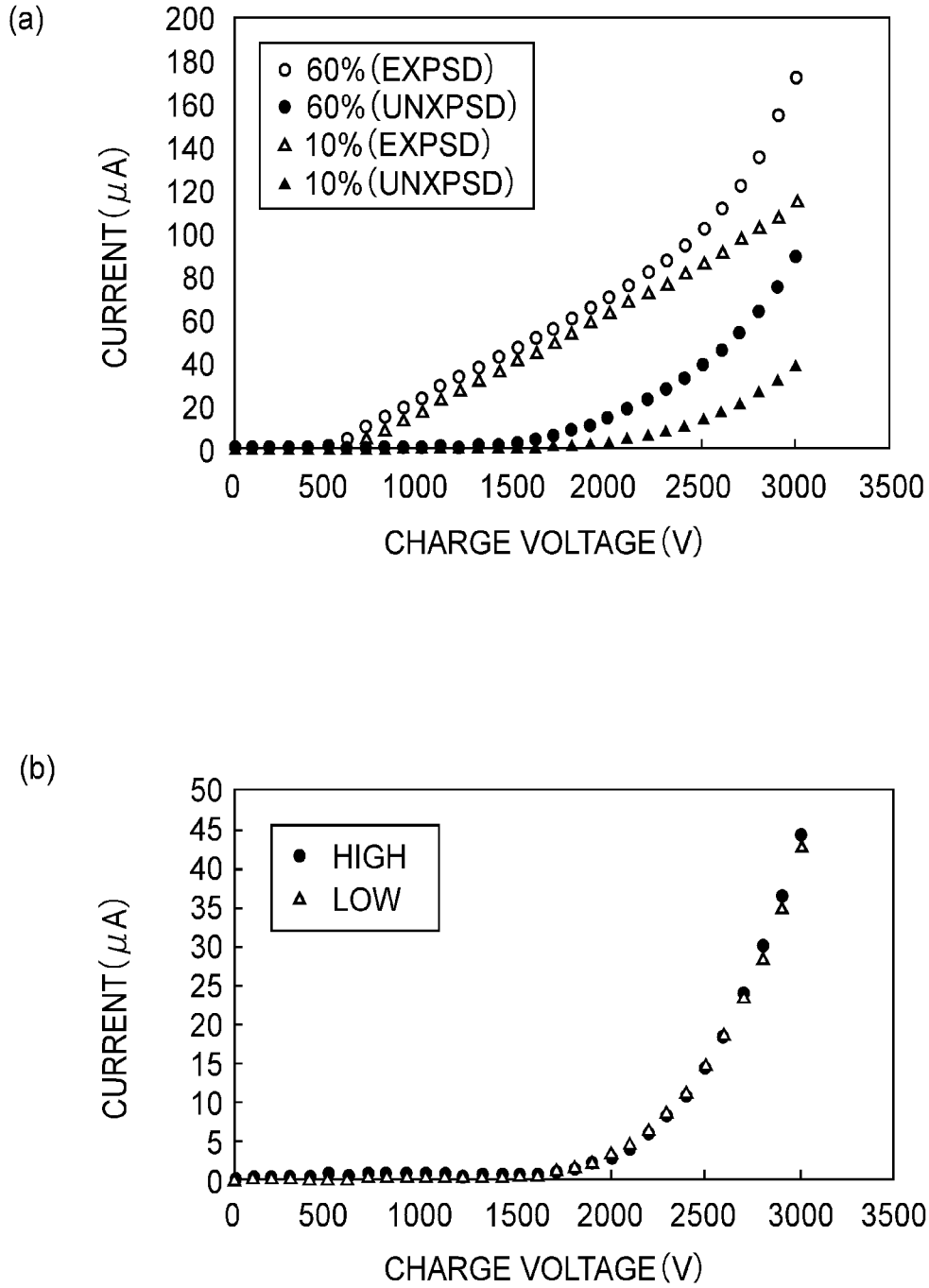

Part (a) of FIG. 2 is a graph showing a charging voltage-current characteristic relative humidity dependency, and (b) of FIG. 2 is a graph showing a charging voltage-current characteristic charging roller resistance dependency.

Figure 3:
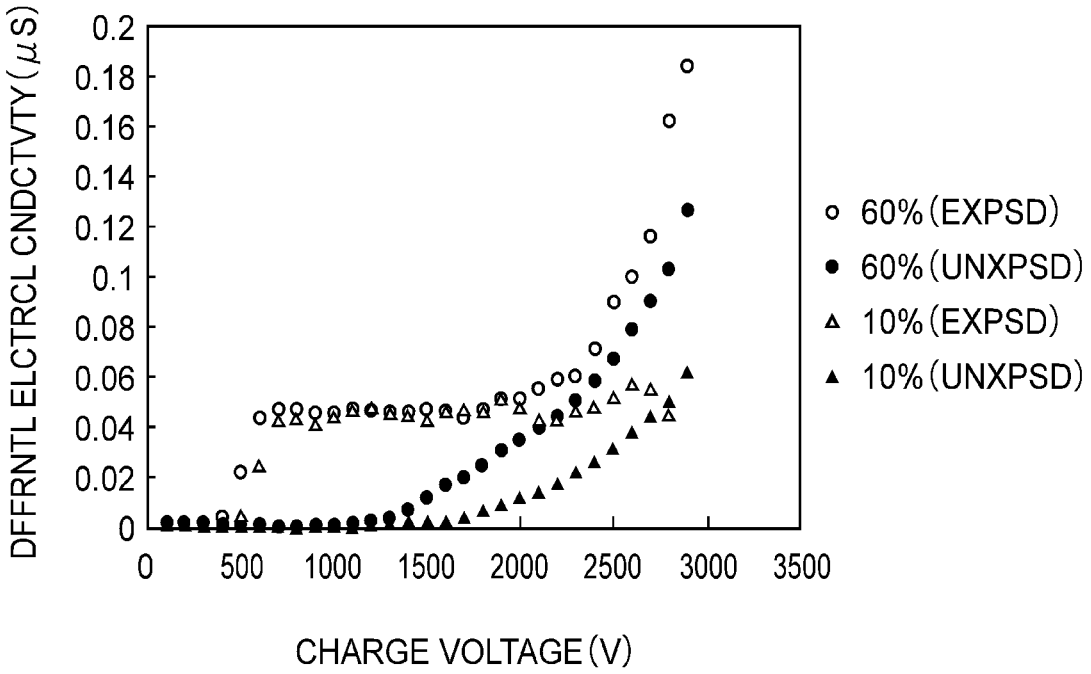

FIG. 3 is a graph showing a charging voltage-differential electroconductivity characteristic converted from the graph of (a) of FIG. 2.

Figure 4:
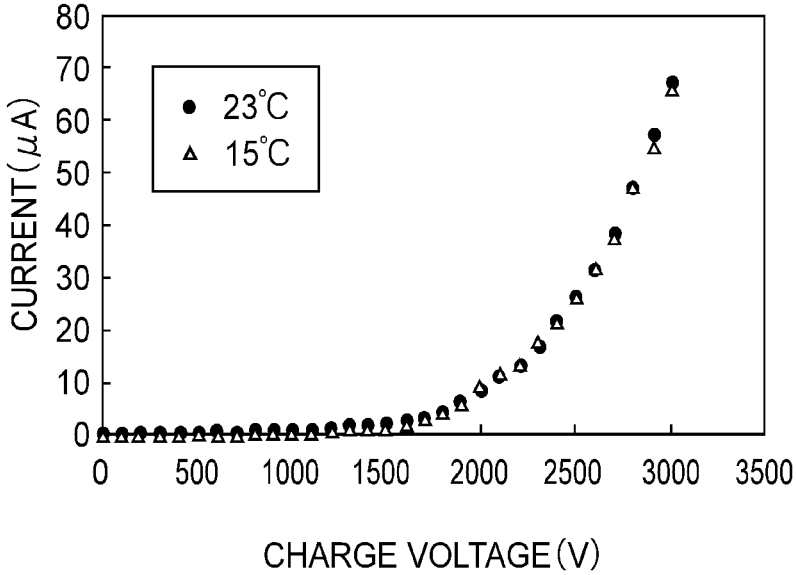
Figure 4:
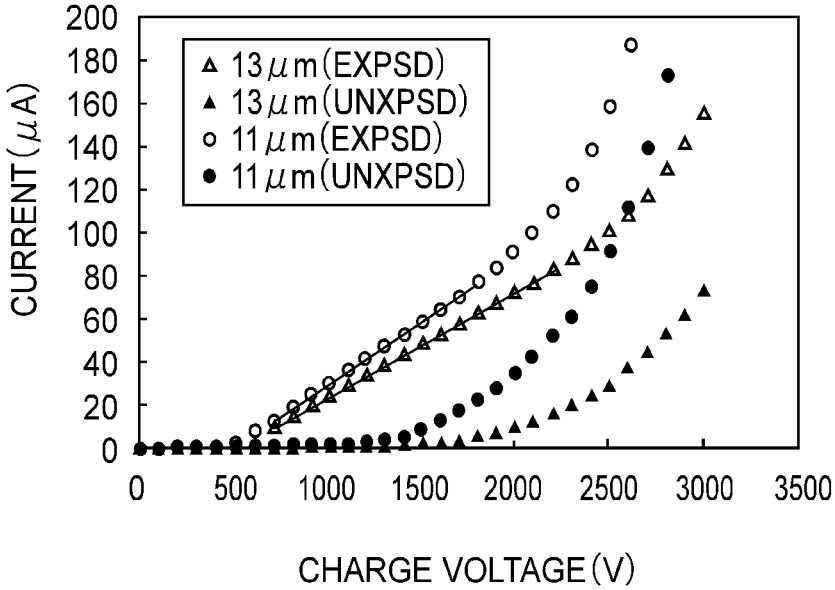

Part (a) of FIG. 4 is a graph showing a charging voltage-current characteristic temperature dependency, and (b) of FIG. 4 is a charging voltage-current characteristic film thickness dependency.

Figure 5:
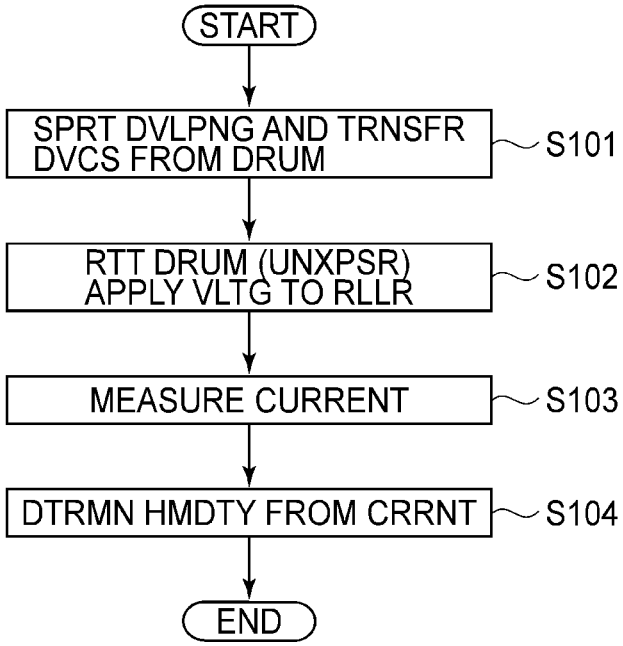

FIG. 5 is a flow chart for illustrating an operation in a humidity detecting mode.

DESCRIPTION OF THE PREFERRED EMBODIMENTS

The image forming apparatus according to the present invention will be described below more specifically with reference to the drawings. Dimensions, materials, shapes and relative arrangements of constituent parts or elements described in the following embodiments should be appropriately changed depending on constitutions and various conditions of the image forming apparatus to which the present invention is applied, and the scope of the present invention is not limited to the following embodiments.

Embodiment 1

Figure 1:
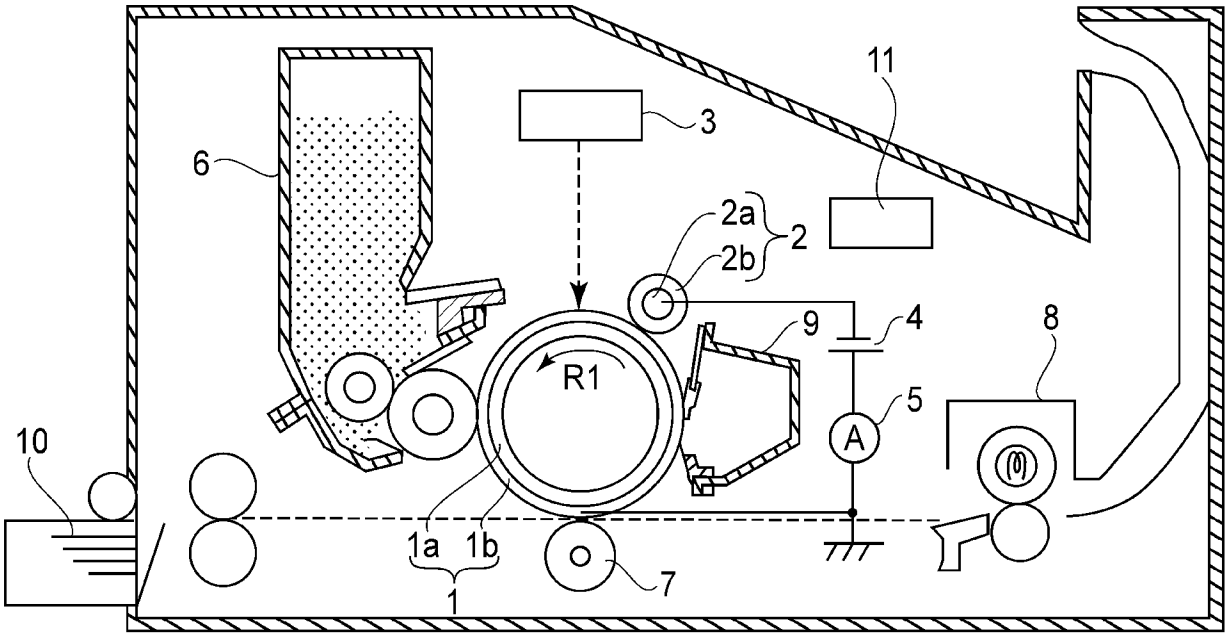
FIG. 1 is a schematic sectional view of an embodiment of an image forming apparatus according to the present invention.

FIG. 1 is a schematic view showing a general structure of the image forming apparatus according to the present invention. In this embodiment, the image forming apparatus includes a drum-shaped electrophotographic member (hereinafter referred to as a photosensitive drum) 1 as a rotatable image bearing member. The photosensitive drum 1 is rotationally driven in an arrow R1 direction and is electrically charged uniformly by a charging roller 2, which is a contact charging device electrically connected to a DC power source 4, which is a DC voltage applying device. Then, the photosensitive drum 1 is irradiated with (exposed to) laser light from a laser optical device 3 which is an exposure device, so that an electrostatic latent image is formed on the surface of the photosensitive drum 1. This electrostatic latent image is developed by a developing device 6 to be visualized as a toner image. In this embodiment, the development is effected by bringing a developing roller as a part of the developing device 6 into contact with the photosensitive drum 1. The visualized toner image on the photosensitive drum 1 is transferred onto a recording medium 10 as a transfer material (toner image receiving member) by transfer device 7. In this embodiment, the transfer is effected by bringing a transfer roller as a part of the transfer device 7 into contact with the photosensitive drum 1. Untransferred toner remaining on the photosensitive drum 1 without being transferred is scraped by a cleaning device 9. The photosensitive drum 1 subjected to cleaning repeatedly performs the above actions to effect image formation. On the other hand, the recording medium 10 onto which the toner image is transferred is subjected to permanent fixing by a fixing device 8 and is discharged to the outside of the image forming apparatus.

A CPU 11 which is a contact device can execute control of an operation in a humidity detecting mode described later. The CPU 11 effects control of rotation and stop of the photosensitive drum 1, control of an output voltage of the DC power source 4 for applying the voltage to the charging roller 2 and detection of an amount of a current passing through an ammeter 5. Further, the CPU 11 effects control for image formation such as control of an output voltage of a power source for applying a voltage to the developing device 6 and control of an output voltage of a power source for applying a voltage to the transfer device 7.

The photosensitive drum 1 as the image bearing member is formed by laminating, on an Al cylinder 1*a* which is an electroconductive base member, an organic photosensitive member 1*b* including a charge transporting layer of polycarbonate or polyarylate. The charging roller 2 is prepared by providing, on a core metal 2*a* which is an electroconductive support, a semiconductive rubber layer 2*b* and exhibits a resistance of about $10^5\Omega$ when the voltage of 200 V is applied to the electroconductive drum. To the charging roller 2, the ammeter 5 as a current detecting means is electrically connected.

[Experiment 1]

First, the following experiment was conducted. In a state in which the developing device 6 and the transfer device 7 were separated (spaced) from the photosensitive drum 1, a constant voltage was applied to the charging roller 2 while rotationally operating the photosensitive drum 1 and the amount of the current at that time was detected by the ammeter 5.

A relationship between the applied voltage and the amount of the current detected by the ammeter 5 when the charging is started and then the photosensitive drum 1 is rotated two full turns or more is shown in (a) of FIG. 2.

A measuring condition was as follows.

As a condition of relative humidity in an environment in which the image forming apparatus was placed, the measurement was conducted at the relative humidities of 10% RH and 60% RH. As a condition of the exposure device 3, the measurement was conducted while exposing the photosensitive member 1*b* to light by the exposure device 3 ("EXPOSED") and was conducted without exposing the photosensitive member 1*b* to light by the exposure device 3 ("UNEXPOSED"). The measured amounts of currents caused a difference due to the humidity. Further, this difference in current amount was larger in the case where the photosensitive member 1*b* was exposed than in the case where the photosensitive member 1*b* was not exposed, and was further large when the voltage was increased, particularly when the voltage was not less than a voltage at which a voltage-current characteristic was diverged from Ohm's law. Whether or not the voltage-current characteristic was diverged from Ohm's law can be easily discriminated by using a differential electrical conductivity. FIG. 3 is a graph showing a charging voltage-differential electrical conductivity characteristic converted from the charging voltage-current characteristic shown in the graph of (a) of FIG. 2. The differential electrical conductivity is a value obtained by differentiating the current with respect to the voltage. A constant differential electrical conductivity shows that the resistance is constant and in such a voltage range, the charging voltage-current characteristic obeys Ohm's law. On the other hand, when the differential electrical conductivity has a slope with respect to the charging voltage, in such a voltage range, it can be said that the charging voltage-current characteristic is diverged from Ohm's law.

When the photosensitive member is exposed to light, clear divergence cannot observed at the humidity of 10% RH. On the other hand, when the photosensitive member is not exposed to light, the divergence was observed from about 1800 V even at the humidity of 10% RH. Further, when the humidity is low, compared with the case of the high humidity, the measured current becomes small.

From these results, it is desirable that the voltage which is not less than the voltage at which the charging voltage-current characteristic is diverged from Ohm's law is applied under a non-exposed condition and a low humidity condition. As a result, even when the humidity is low, the measured current can be made large and therefore it is possible to enhance measurement detection accuracy at the low humidity.

In this embodiment, the relative humidity of 10% RH refers to the low humidity, and with respect to whether or not the charging voltage-current characteristic is diverged from Ohm's law, when the slope of the differential electrical conductivity with respect to the charging voltage is not less than $2.75\times10^5$ μS/V and the charging voltage is not less than a voltage at which the differential electrical conductivity increases with an increase in charging voltage, the charging voltage-current characteristic was judged as being diverged from Ohm's law.

Incidentally, when the rotational operation of the photosensitive drum 1 was not performed, the current amount itself became small. By performing the rotational operation of the photosensitive drum 1, the detected current value becomes large, so that it is possible to easily detect the humidity.

With reference to FIG. 5, the operation in the humidity detecting mode in the present invention will be described. When the operation in the humidity detecting mode is started, first, the developing device 6 and the transfer device 7 are separated from the photosensitive drum 1 (S101). Then, a predetermined area (first area) of the photosensitive member 1*b* is electrically charged by applying a voltage (first DC voltage) of −2.5 kV to the charging roller 2. At this time, the first area is prevented from being exposed to light by the exposure device 3. Then, the photosensitive member 1*b* is rotated and thereafter the charged first area is electrically charged again by applying the voltage of 2.5 kV to the charging roller 2 (S102). Then, the amount (first current amount) of the charging voltage passing through the first area when the first area is electrically charged again by applying the voltage of 2.5 kV to the charging roller 2 is detected by the ammeter 5 (S103). By comparing this current amount with those in a current amount table at various humidities obtained in advance, the humidity can be detected (determined) (S104).

The above operation in the humidity detecting mode was performed during actuation of the image forming apparatus and with timing of a density control sequence, and on the basis of the detected humidity, a condition relating to the image formation during the image formation was changed so as to satisfy a desired image density. Specifically, control of a charging potential applied to the charging roller 2 and control of a developing potential applied to the developing device were effected.

This humidity detecting mechanism will be described.

Generally, even when a material having a high resistance which is called an insulation member is used, under application of a high electric field, the charging voltage-current characteristic is diverged from Ohm's law and thus a large current passes through the material. Similarly, the photosensitive member 1*b* in an unexposed state has the high resistance but when a high electric field is generated between the charged surface of the photosensitive member 1*b* and the base member 1*a*, the photosensitive member 1*b* cannot hold the surface electric charge and thus the current passes through the photosensitive member 1*b*. This current is referred to as a dark current.

In this embodiment, the surface of the photosensitive member 1*b* charged to a predetermined potential attenuates its surface potential during the rotational operation of the photosensitive drum 1, so that the current flows into the electroconductive base member 1*a*. This current amount is equivalent to the amount of the charge flowing out of the surface of the photosensitive member 1*b* and is equal to the amount of the current passing through the charging roller 2 when the photosensitive member 1*b* is charged again after the rotational operation thereof. Therefore, by detecting the current passing through the charging roller 2 after the photosensitive drum 1 is rotated two full turns or more, it is possible to obtain information on a dark current characteristic, i.e., the resistance of the photosensitive member 1*b*.

Incidentally, in the organic photosensitive member, a polymeric material is used. It has been known that the polymeric material absorbs ambient moisture depending on the humidity and thus the resistance or dielectric constant is changed. This property is used in the humidity sensor as it is. Also in this embodiment, it would be considered that the organic photosensitive member 1*b* absorbs moisture in the neighborhood thereof to change the resistance thereof. The photosensitive member 1*b* itself absorbs moisture and behaves like a humidity sensor and therefore it can be said that large superiority is ensured by the detection of the humidity, in the neighborhood of the photosensitive member 1*b*, which is most closely associated with the image formation.

In this embodiment, the resistance of the photosensitive member 1*b* is detected and therefore even when the resistance of the charging roller 2 which is smaller than that of the photosensitive member 1*b* is largely fluctuated, the current amount is less influenced. Part (b) of FIG. 2 is a graph showing a result of the same experiment as the experiment 1 except for using charging rollers different in resistance. In this experiment, the current amount is detected under the non-exposure condition and a condition of the temperature of 23° C. and the relative humidity of 60% RH. Other conditions are the same as those in the experiment 1. In (b) of FIG. 2, "LOW" represents data of the charging roller showing the resistance of 120 kΩ when the voltage of 200 V is applied to the electroconductive drum in the above-described manner, and "HIGH" represents data of the charging roller showing the resistance of 780 kΩ. Although the resistance of the high resistance charging roller is 6 times or more larger than that of the low resistance charging roller, it is understood that the detected current amount is little changed.

The resistance of the charging roller 2 has already varied during manufacturing and is largely fluctuated due to storing or durable progression in various environments. The humidity can be detected without being substantially influenced by such a fluctuation in resistance of the charging roller 2. This is also large superiority. Incidentally, in the humidity detection in this embodiment, it has been found that the humidity detection is not influenced by the temperature. Specifically, (a) of FIG. 4 shows a result of an experiment in which the humidity is fixed at 60% RH under the condition of (b) of FIG. 2 and the charging voltage-current characteristics at 23° C. and 15° C. are compared. From the graph of (a) of FIG. 4, it is understood that the charging voltage-current characteristic is not influenced by the temperature.

However, the dark current amount is small in general and thus it is difficult to detect the dark current. In this embodiment, the rotational operation of the photosensitive drum 1 permits an increase in substantial surface area of the photosensitive member 1*b* to increase the dark current amount, so that the dark current can be easily detected. Further, the voltage which is not less than the voltage at which the charging voltage-current characteristic is diverged from Ohm's law remarkably increases the dark current amount to permit easy detection of the dark current. As a result, the ammeter is not required to provide high accuracy, so that the cost can be reduced.

In the operation in the humidity detecting mode, it is also possible to apply a plurality of voltages thereby to detect corresponding current values. The resultant information on the current values corresponding to the plurality of voltages is compared with a humidity-current amount relationship which is obtained in advance, so that the accuracy can be further enhanced. For example, in the case where the humidity is judged as being 40% RH from the current amount under application of the voltage of −2.5 KV and is judged as being 50% RH from the current amount under application of the voltage of −3 kV, the humidity may be judged as being 45% RH which is an average of 40% RH and 50% RH.

During the operation in the humidity detecting mode in the image forming apparatus of the present invention, the developing device 6 and the transfer device 7 were separated from the photosensitive drum 1. This is because the charges are prevented from flowing from the photosensitive drum 1 to the developing device 6 or the transfer device 7 to prevent measurement failure of a proper dark current amount. Incidentally, in this embodiment, the transfer roller contacted to the photosensitive drum 1 is used as the transfer device but in the case of such a transfer device that the toner image is transferred from the image bearing member onto the intermediary transfer belt, the intermediary transfer belt may preferably be separated from the photosensitive drum 1. Incidentally, as a constitution other than the constitution in which the developing device 6 and the transfer device 7 are separated from the photosensitive drum 1, the developing device and the transfer device 7 may be "electrically floating". Here, electrically floating refers to a state in which the potentials of the developing device 6 and the transfer device 7 are electrically separated from a reference potential such as the applied voltage or ground potential by, e.g., a switch. In this state, the potentials of the developing device 6 and the transfer device 7 are equal to the surface potential of the photosensitive drum 1, so that the above-described flowing-out of the charges is prevented to permit the measurement of the proper dark current amount.

Further, the operation in the humidity detecting member may also be performed, in addition to the time of actuation of the image forming apparatus or the timing of the density control sequence, after a lapse of a predetermined time or during pre- or post-rotation after printing on a predetermined number of sheets.

On the basis of the humidity information detected in the operation in the humidity detecting mode in the present invention, the condition relating to the image formation other than the charging potential and the developing potential may also be changed. For example, a toner discharging frequency of deteriorated toner accommodated in the developing device may be changed, or the humidity information may also be used for control of the transfer potential applied to the transfer device, correction of remaining amount detection of the toner accommodated in the developing device, and the like.

As described above, without using the particular sensor or member, it was possible to easily detect the humidity in the neighborhood of the photosensitive member 1*b* with accuracy.

Embodiment 2

In this embodiment, the general structure of the image forming apparatus is the same as that described in Embodiment 1 and therefore the description in Embodiment 1 is also applied to this embodiment. Thus, redundant description will be omitted in this embodiment.

The organic photosensitive member 1*b* caused friction with members contacted thereto such as the charging roller 2 and the cleaning device 9, so that surface abrasion occurs and a film thickness of the photosensitive member 1*b* is decreased. The current amount relates to an intensity of an electric field between the surface of the photosensitive member 1*b* and the electroconductive base member 1*a*. For this reason, the voltages and current amounts were measured similarly as in Embodiment 1 by using photosensitive members 1*b* different in film thickness. The results are shown in a graph of (b) of FIG. 4.

As a result, even in either case of the exposure and non-exposure, the measured current amount provides a difference in charging voltage-current characteristic depending on the film thickness. In the case where the photosensitive member 1*b* is exposed, a ratio between the slopes of the charging voltage-current characteristics in a voltage range from the electric discharge start voltage to the (upper-limit) voltage at which the charging voltage-current characteristic obeys Ohm's law was substantially equal to an inverse ratio of the film thickness. In FIG. 4, the slope for the film thickness of 13 μm was 0.0582 A/V and the slope for the film thickness of 11 μm was 0.0488 A/V, so that the ratio of the film thickness was 13/11=1.18 and on the other hand the inverse ratio of the slopes was 0.0582/0.0488=1.19, thus being substantially equal to each other. Incidentally, the electric discharge voltage refers to a voltage applied to the charging roller 2 when the electric discharge starts between the exposed photosensitive member 1*b* and the charging roller 2.

Therefore, first, a predetermined area (second area) of the photosensitive member 1*b* exposed to light by the exposure device 3 is charged by applying the voltage of −700 V (second DC voltage) to the charging roller 2 and at that time, the amount of the current (second current) is detected by the ammeter 5. Similarly, the predetermined area (second area) of the photosensitive member 1*b* exposed to light by the exposure device 3 is charged by applying the voltage of −1800 V (second DC voltage) to the charging roller 2 and at that time, the amount of the current (second DC voltage) to the charging roller 2 and at that time, the amount of the current (second current) is detected by the ammeter 5. From these results, the film thickness information is calculated from the slope of the charging voltage-current characteristic. Next, similarly as in Embodiment 1, in the state in which the photosensitive member 1*b* was not exposed, the voltage of −2.5 kV was applied to the charging roller 2 while performing the rotational operation of the photosensitive drum 1, and the amount of the current (first current) after the photosensitive drum 1 was rotated two full turns or more was detected. By comparing this current amount (first current) with various humidity values obtained in advance and with a table of data of the current amount with respect to the film thickness information, it was possible to detect the humidity without being influenced by the film thickness. The film thickness information is obtained from the second current and therefore in this embodiment, the CPU 11 detects the information on the humidity on the basis of the first current and the second current.

That is, in this embodiment, a correction condition is calculated on the basis of the voltage applied from the DC voltage application means in the light exposure state and the current detected by the current detecting means, and on the basis of this calculation result, the humidity detected in the operation in the humidity detecting mode is corrected.

A mechanism for detecting the film thickness information will be described.

Between a charge amount Q and a surface potential V at the surface of the photosensitive member 1*b*, when an electrostatic capacity is C, the following formula 1 is satisfied.

$$Q=CV \quad \text{(formula 1)}$$

A relationship among two surface potentials $V_1$ and $V_2$ and two charge amounts $Q_1$ and $Q_2$ is represented by a formula 2 shown below when a dielectric constant of the photosensitive member 1*b* is ∈, a charged area is S and the film thickness of the photosensitive member is d.

$$\frac{Q_1 - Q_2}{V_1 - V_2} = C = \varepsilon\frac{S}{D} \quad \text{(formula 2)}$$

A charging current amount i is equivalent to the charge amount Q, and a charging voltage v and an electric discharge start voltage $V_{th}$ satisfy a formula 3 below.

$$V=v-V_{th} \quad \text{(formula 3)}$$

Therefore, a ratio of (charging current/voltage) which is the slope of the charging voltage-current characteristic is represented by a formula 4 shown below, so that it is understood that the ratio of the slopes is associated with the inverse ratio of the film thickness d.

$$\frac{i_1 - i_2}{v_1 - v_2} \propto \frac{Q_1 - Q_2}{(V_1 + V_{th}) - (V_2 + V_{th})} = \frac{Q_1 - Q_2}{V_1 - V_2} = \varepsilon\frac{S}{d} \quad \text{(formula 4)}$$

Incidentally, the light exposure is not limited to that by the exposure device 3 but may also be that by a pre-exposure device (not shown in FIG. 1).

As described above, even in the case where the fluctuation in film thickness of the member 1*b* occurred, it was possible to easily detect the humidity in the neighborhood of the photosensitive member 1*b* with accuracy without using the particular sensor or member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 178208/2010 filed Aug. 6, 2010 and 149449/2011 filed Jul. 5, 2011, which are hereby incorporated by reference.

What is claimed is:

1. An image forming apparatus comprising:

a rotatable image bearing member including an electroconductive base member and a photosensitive member formed on the electroconductive base member;

a contact charging device for electrically charging the photosensitive member;

a DC voltage applying device for applying a DC voltage to said contact charging device;

an exposure device for exposing the charged photosensitive member to light;

a current detecting device for detecting a current passing from said contact charging device to the electroconductive base member of said image bearing member; and a control device capable of executing an operation in a humidity detecting mode in which an area of the photosensitive member is electrically charged by applying a DC voltage to said contact charging device and the photosensitive member is rotated without exposing the area to the light by said exposure device and then the area is electrically charged again by applying the DC voltage to said contact charging device, wherein said control device detects information on humidity on the basis of a current detected by said current detecting device when the area is electrically charged again by applying the DC voltage to said contact charging device.

2. An apparatus according to claim 1, wherein in the operation in the humidity detecting mode, a second area of the photosensitive member exposed to the light by said exposure device is electrically charged by applying a second DC voltage to said contact charging device, and wherein said control device detects the information on the humidity on the basis of the current and a second current which is detected by said current detecting device when the second area is electrically charged by applying the second DC voltage to said contact charging device.

3. An apparatus according to claim 1, wherein in the operation in the humidity detecting mode, the DC voltage applied to said contact charging device is not less than a voltage at which the DC voltage applied to said contact charging device and the charging voltage detected by said current detecting device are diverged from Ohm's law.

4. An apparatus according to claim 1, wherein a condition relating to image formation is changed on the basis of the information on the humidity.

5. An apparatus according to claim 1, further comprising a developing device for developing an electrostatic latent image on said image bearing member into a toner image in contact with said image bearing member during image formation, wherein said developing device is separable from said image bearing member and is separated, in the operation in the humidity detecting mode, from said image bearing member.

6. An apparatus according to claim 1, further comprising a transfer device for transferring a toner image from said image bearing member onto a toner image receiving member in contact with said image bearing member during image formation, wherein said transfer device is separable from said image bearing member and is separated, in the operation in the humidity detecting mode, from said image bearing member.

7. An apparatus according to claim 1, further comprising a developing device for developing an electrostatic latent image on said image bearing member into a toner image in contact with said image bearing member during image formation, wherein said developing device is electrically floating in the operation in the humidity detecting mode.

8. An apparatus according to claim 1, further comprising a transfer device for transferring a toner image from said image bearing member onto a toner image receiving member in contact with said image bearing member during image formation, wherein said transfer device is electrically floating in the operation in the humidity detecting mode.

* * * * *